United States Patent [19]

Debaes

[11] Patent Number: 5,033,516

[45] Date of Patent: Jul. 23, 1991

[54] DEVICE FOR GUIDING RAPIER RODS IN A RAPIER LOOM

[75] Inventor: John Debaes, Wenduine, Belgium

[73] Assignee: N. V. Michel Van De Wiele, Kortrijk/Marke, Belgium

[21] Appl. No.: 472,410

[22] Filed: Jan. 31, 1990

Related U.S. Application Data

[63] Continuation-in-part of Ser. No. 256,756, Oct. 12, 1988, abandoned.

[30] Foreign Application Priority Data

Oct. 12, 1987 [BE] Belgium ..... 8701166

[51] Int. Cl.[5] ..... D03D 47/18

[52] U.S. Cl. ..... 139/449

[58] Field of Search ..... 139/441, 444, 445, 446, 139/449

[56] References Cited

U.S. PATENT DOCUMENTS

| | | | |
|---|---|---|---|
| 733,586 | 7/1903 | Hutchins . | |
| 3,999,580 | 12/1976 | Sparling . | |
| 4,040,453 | 8/1977 | Juillard et al. . | |
| 4,520,848 | 6/1985 | Lucian et al. . | |
| 4,638,839 | 1/1987 | Pezzoli | 139/449 |
| 4,653,547 | 3/1987 | Jankovsky | 139/449 X |

FOREIGN PATENT DOCUMENTS

| | | | |
|---|---|---|---|
| 621952 | 2/1963 | Belgium | 139/449 |
| 1555432 | 1/1969 | France . | |
| 2320371 | 3/1977 | France . | |
| 408807 | 9/1966 | Switzerland | 139/449 |
| 2141746 | 1/1985 | United Kingdom . | |

*Primary Examiner*—Andrew M. Falk

*Attorney, Agent, or Firm*—James Creighton Wray

[57] ABSTRACT

Device for guiding the rapier rods in a rapier loom, comprising several rapier guides. The first rapier guide supports the rapier rod heads and consists of guide tables which are adjustably mounted on an adjustable bracket, which in turn is adjustably mounted on an adjustable carrier structure. The carrier structure is adjustably mounted on a suspension bar and the suspension bar is adjustably mounted on the rapier guide housing. The second rapier guide consists of a number of rollers which guide the back of the rapier rods and position the raoier rods relative to the vertical shaft of the drive gear wheels. These rollers are provided in a roller frame, and these rollers can be set and fixed in a vertical and horizontal direction perpendicular to the rapier rods. The roller frame is adjustably mounted to the rapier guide housing. The third rapier guide consists of profile guides which are accommodated so that they are adjustable in height in a U-section. The U-section is fixed against the rapier guide housing. The rapier guide housing is mounted on a boss so that it is adjustable about a center line which coincides with the center line of the shaft of the drive gear wheels and allows the rapier guide housing to be set and fixed in different directions on the frame of the loom, so that the rapier guide housing coordinates these three guides so that they function as one unit.

9 Claims, 5 Drawing Sheets

DEVICE FOR GUIDING RAPIER RODS IN A RAPIER LOOM

This application is a continuation-in-part of application Ser. No. 256,756 filed Oct. 12, 1988 abandoned.

BACKGROUND OF THE INVENTION

The invention relates to the device for guiding the to and fro moving rapier rods of a rapier loom in which the weft insertion takes place by means of rapiers. Such rapier rods have in general a toothed rack with which, as described in Belgian Patent 868,946, a gear wheel, preferably placed on a vertical shaft, mates to drive the rapier rod.

The rapier rods must be supported and guided next to the edge of the fabric by guide means, so that they perform the desired stroke during their to and fro movement. Said guide means are essentially made up of three parts: opposite the drive gear wheel there are a number of rollers, the rapier rod rests in a profiled guide, and the rapier rod heads are supported and guided by the guide tables.

Hitherto these three parts have each been fixed individually to the frame. This means that for setting the takeover position in the center of the shed, the place where the insert and receiving rapier meet each other and the weft thread is taken over, these three parts must be set separately in order to give each rapier the desired direction of movement, which requires considerable setting time.

SUMMARY OF THE INVENTION

The object of the present invention is to reduce this setting time considerably.

The device according to the invention consists of at least one guide means disposed at a certain distance from the rapier driving means and along the longitudinal direction of the rapier rods, and is characterized in that this guide means is adjustably disposed on a guide which is set up in an adjustable manner on the frame of the loom.

In a preferred embodiment of the device according to the invention, each rapier rod is driven by a corresponding drive gear wheel. The rapier guide housing is rotatably and adjustably mounted around a shaft, which centerline coincides with the axis centerline of the drive gear wheels. The device is arranged so that, even though each guide means may be adjusted independently, the rapier guide housing coordinates the guide means to function as one unit.

These and further and other objects and features of the invention are apparent in the disclosure, which includes the above and ongoing written specification, with the claims and the drawings.

BRIEF DESCRIPTION OF THE DRAWINGS

FIG. 1*b* shows the detail and a further exploded view of the elements for adjustably mounting the rollers on the roller frame.

DETAILED DESCRIPTION OF THE DRAWINGS

Figure 1A:
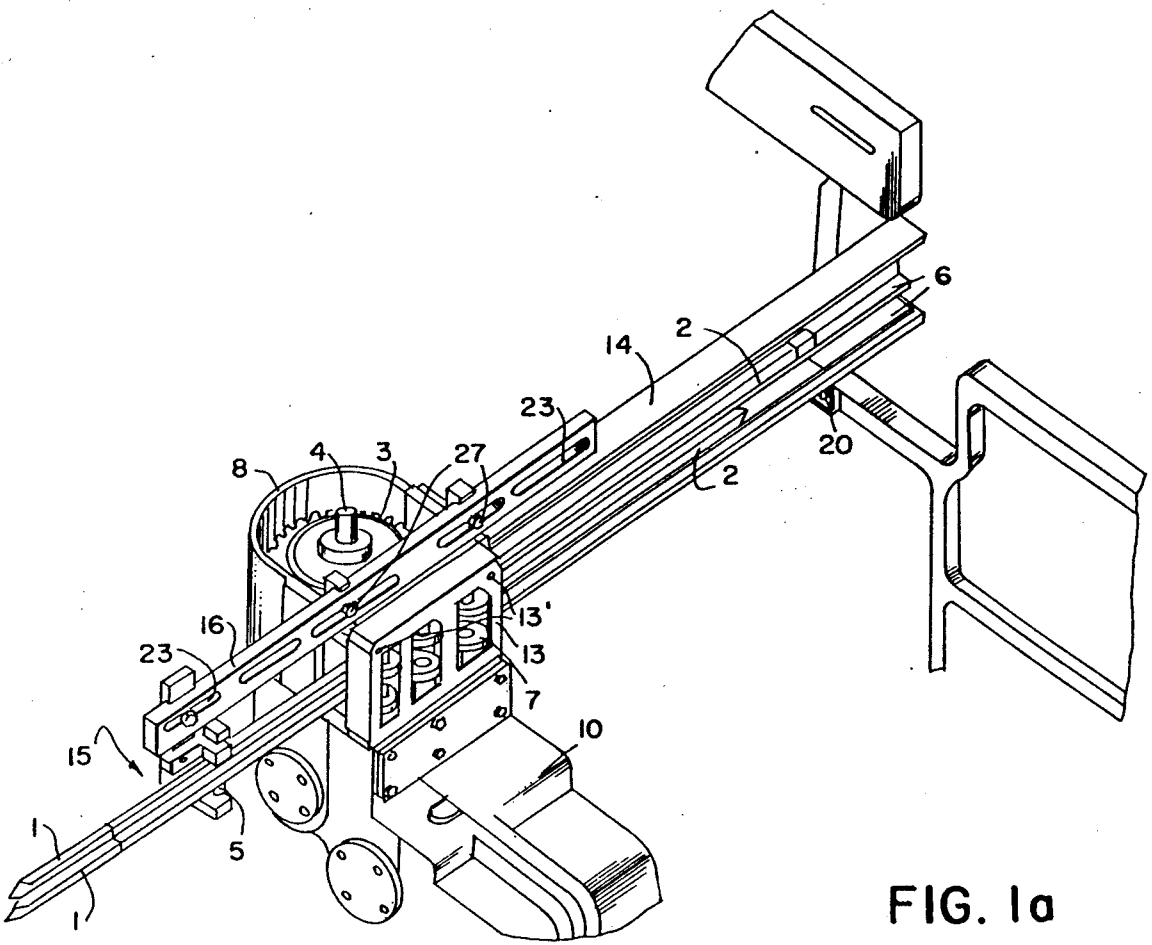
FIG. 1*a* is a perspective view of the rapier guide means according to the invention, with an indication of the rapier rods.

In a rapier loom the rapier heads 1 (FIG. 1*a*) are fixed to the ends of the two rapier rods 2, one above the other. Each of the rapier rods 2 is driven by a drive gear wheel 3, which is preferably situated in a horizontal plane and is driven by a vertical shaft 4. The rapier rods 2 must be supported and guided at various points, so that in their to and fro movement they move in the right direction, in such a way that the insert and receiving rapier meet each other at their takeover position for the transfer of the weft threads.

For this purpose, each rapier rod is guided by three guide means. The rapier rod head is supported by a guide table 5, the rapier rod tail is by a profiled guide 6, and opposite the drive gear wheel 3 provision is made for a number of rollers 7 which guide the back of the rapier rods 2 and position the rapier rods 2 relative the vertical shaft 4, so that each rod mates with the corresponding drive gear wheel 3 place on said shaft 4.

Figure 1B:
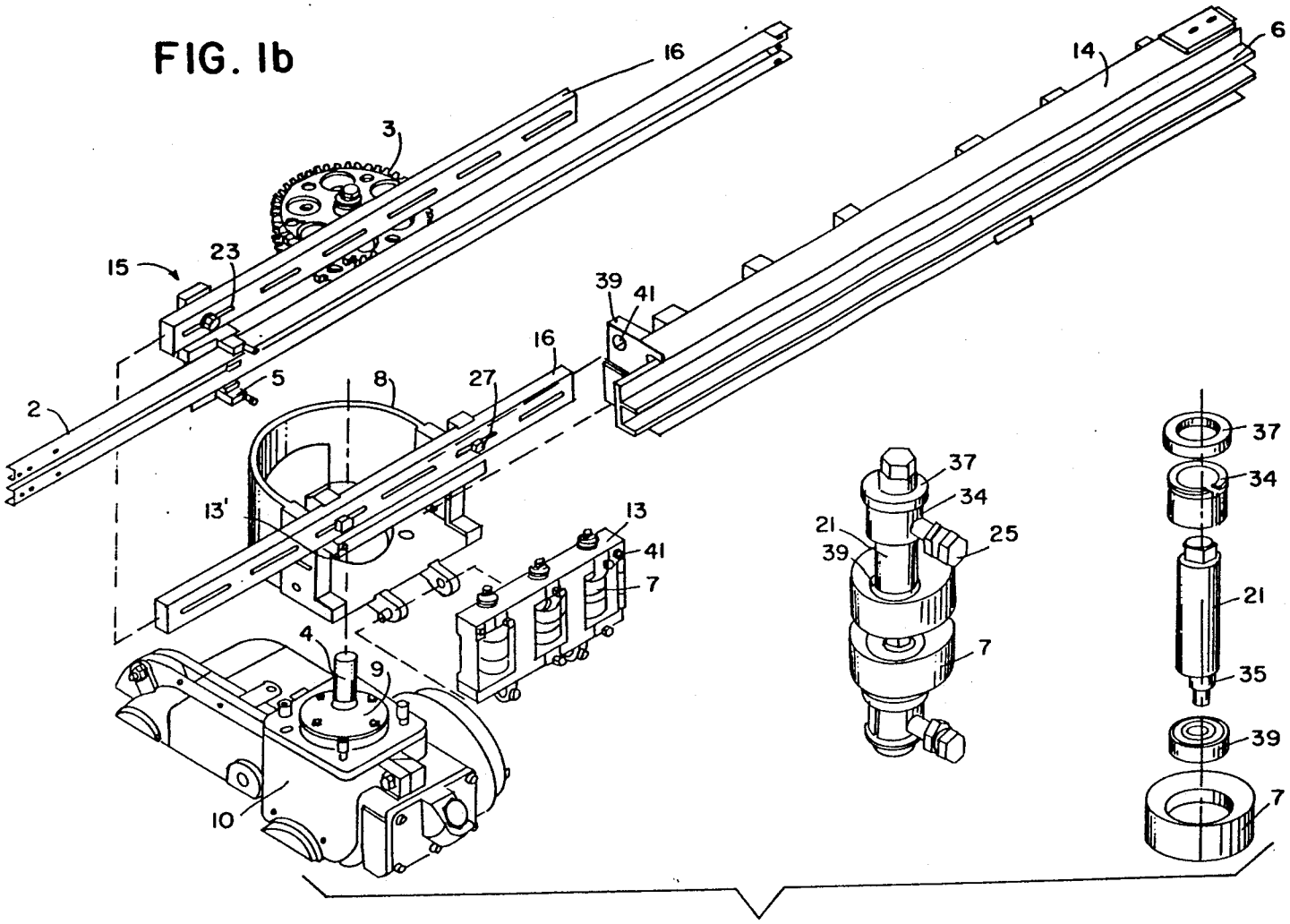
FIG. 1*b* is an exploded view of the rapier guide means as shown in FIG. 1*a*. Also.
Figure 6A:
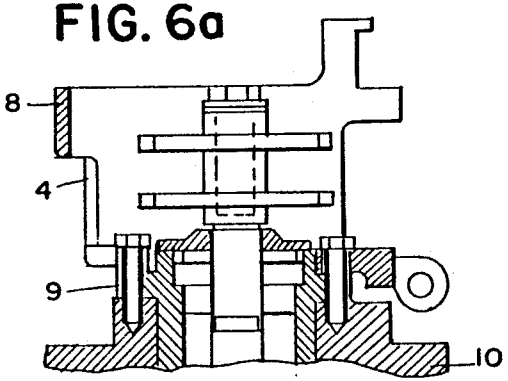
FIGS. 6*a* and 6*b* show, in a partial cross-section and a top view, the means of fixing the position of housing, which is rotatably mounted on a boss.
Figure 6B:
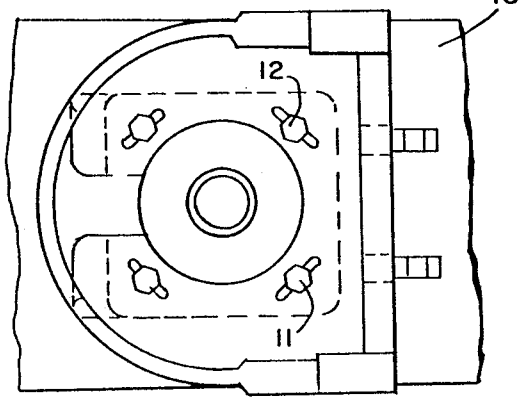

In the device according to the invention, these three guide means are connected so that they are adjustable and function as one guide unit, and these three guide means are adjustably connected to one or more parts fixed on the frame of the loom. These three guide means are disposed at a certain distance from each other near the rapier driving means and along the longitudinal axis of the rapier rods 2. A rapier guide housing 8 is provided for the purpose of coordinating these three guide means so that they function as one unit. As shown in FIGS. 1*b* and 6*a*, the rapier guide housing 8 is mounted on a boss 9. Boss 9 is not a part of the rapier guide housing 8, but is fixed directly to the loom housing 10. As shown in FIGS. 1*b* and 6*b*, the rapier guide housing has a centerline which coincides with the centerline of the shaft 4 of the drive gear wheels.

FIG. 1*b* illustrates an exploded view of the preferred embodiment of the present invention. This exploded view shows how the three guide means are connected so that they may be adjusted and function as one guide unit in guiding the rapier rods 2. FIG. 1*b* shows that each of the rapier rods 2 is provided with its own corresponding drive gear wheel 3. The drive gear wheels 3 are placed on shaft 4. These drive gear wheels 3 are found within the rapier guide housing 8.

As shown in FIG. 1*b*, adjustable carrier structure 15 is adjustably mounted on the suspension bar 16 by a third adjustable means, so that it may be adjusted in a horizontal direction parallel to the rapier rods 2 within slot 23 of the suspension bar 16. This first guide means consists of guide table 5, which is adjustably mounted on the adjustable carrier structure 15 by a first adjustable means for adjusting the guide in a horizontal direction perpendicular to the rapier rods. Guide table 5 is also adjustable mounted on adjustable carrier structure 15 by a second adjustable means for adjusting the height of the guide tables in a vertical direction perpendicular to the rapier rods.

Suspension bar 16, which is provided with a plurality of slots 23, is also adjustably mounted to the rapier guide housing 8 by screws 27 so that suspension bar 16 is also adjustable in a horizontal direction parallel to the rapier rods 2.

Further, FIG. 1*b* shows the U-section 14, to which is adjustably mounted another guide means by a sixth adjustable means and the guide means consists of profile guides 6. U-section 14 is provided with a mounting means 39. Mounting means 39 is fixedly mounted on the rapier guide housing 8 by the insertion of a screw (not shown) through slot 41 of the mounting means 39.

A further guide means of the present invention consists of rollers 7 adjustably mounted by a fourth adjustable means within the roller frame 13. As can be seen in FIG. 1*b*, the rapier guide housing 8 is provided at its lower end with two appendages, to which the bottom of roller frame 13 is pivotally attached. Also, rapier housing 8 is provided with holes 13' at its upper end, so that roller frame 13 may be adjustable mounted by a fifth adjustable means, in a horizontal direction perpendicular to the rapier rods 2 by adjusting screws 41 in holes 13' of the rapier guide housing 8.

Further, FIG. 1*b* provides detail and exploded views of the fourth adjustable means for adjustably mounting the rollers 7 within the roller frame 13. Roller 7 is provided with a bearing 39 for attaching the rollers to an excentric stud 35 from axes 21. The axes 21 are fixed in a split bush 34 by means of a pressure screw 25. The axes 21 are vertically adjustable by sliding in a vertical direction in the split bush, and in a horizontal direction by rotating in the split bush 34. Also a lock washer 37 is provided to hold the axes 21 within the roller frame 13.

Boss 9 is rotatably mounted round the vertical shaft 4 of the drive gear wheels 3 so that the rapier guide housing 8 can be set and fixed in different direction on the frame 10 of the loom.

Further details of attachment of the rapier guide housing are shown in FIGS. 6*a* and 6*b*. The rapier guide housing 8 is provided with a number of slots 11, through which bolts 12, which can be tightened in the loom housing 10, project. It is because of the rotation of housing 8 about boss 9 that the angular direction of the guide housing 8, with the complete device, is adjustable in relationship with loom housing 10. This allows the rapier guide housing 8 to be rotatably adjustable by a seventh adjustable means about the boss 9, but this rotational adjustment is limited to the length of the slots 11. Once the rapier guide housing 8 has been adjusted about the boss 9, the bolts 12 are then tightened in the loom housing 10, so as to hold the rapier guide housing fixed in this desired direction. Shaft 4 has its bearings in boss 9. The rapier guide housing 8 has preferably a semicylindrical shape, standing upright round the drive gear wheels 3 to protect them.

Figure 5A:
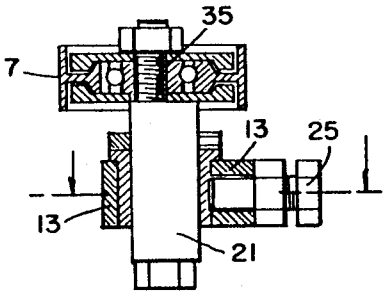
FIGS. 5*a* and 5*b* show in two partial cross-sections the means of adjustably mounting the rollers on the roller frame.
Figure 5B:
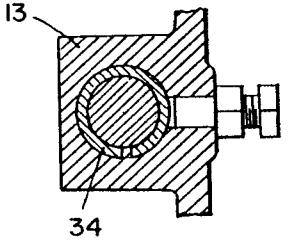

FIGS. 5*a* and 5*b* show in two partial cross-sections the means for adjustably mounting rollers 7 in roller frame 13. In FIG. 5*a*, rollers 7 are attached to an excentric stud 35 from axes 21. The axes 21 are fixed in a split bush 34 by means of a pressure screw 25. The rollers 7 are adjustable in a vertical direction perpendicular to the rapier rods by sliding the axes 21 in a vertical direction in the split bush 34. The axes 21 are horizontally adjustable by rotating in the split bush 34.

The profiled guides 6 are accommodated so that they are adjustable in height in a U-section 14, which has a fixed direction relative to the rapier guide housing 8. The U-section 14 is fixed against the rapier guide housing 8, and disposed on the side of the rapier driving means opposite to the side turned to the shed.

Figure 3:
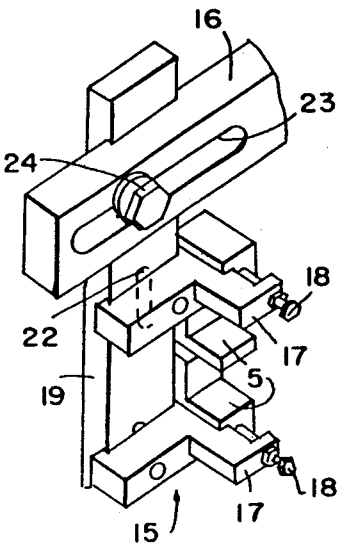
FIG. 3 is a perspective view of the guide tables of the rapier guide means according to the invention.
Figure 2:
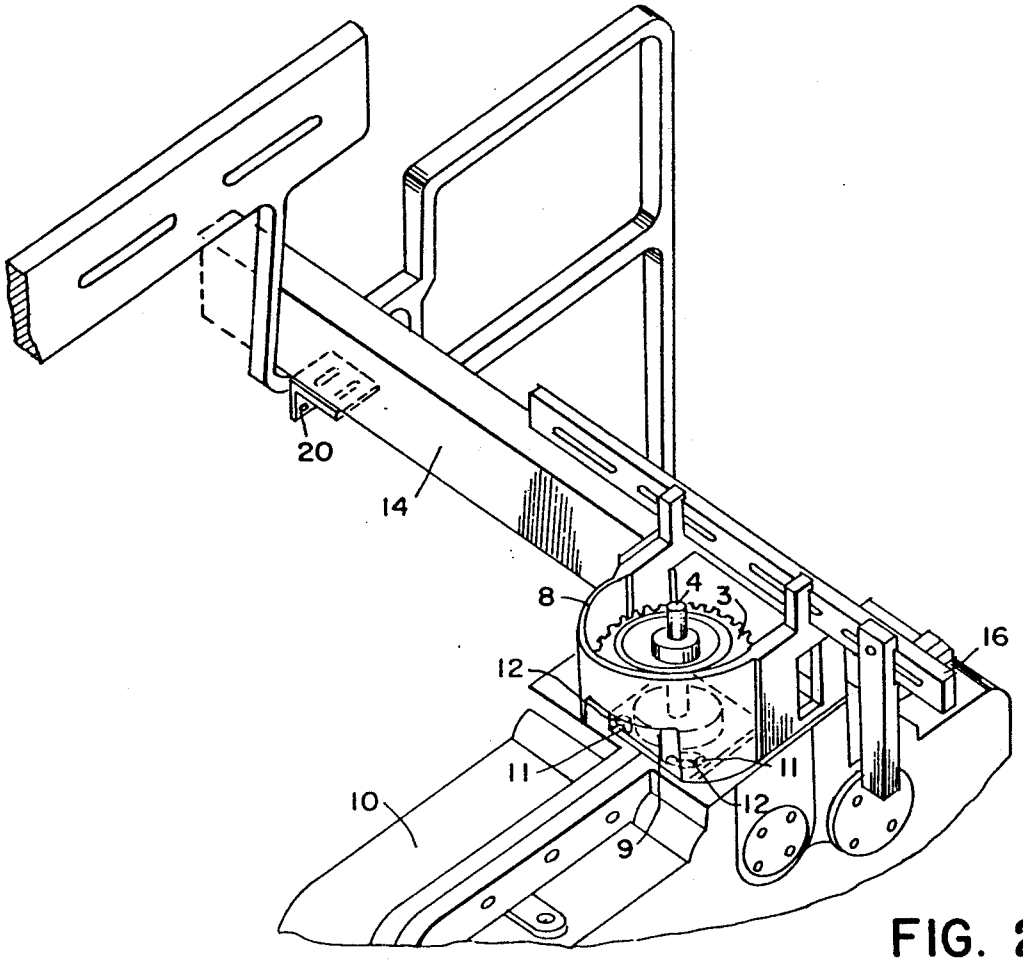
FIG. 2 is a perspective view from another angle on the rapier guide means according to the invention.

As shown in FIG. 3, the carrier structure 15 is adjustably mounted on a suspension bar 16, which is adjustably fixed to the rapier guide housing so that it has a fixed direction relative to the rapier guide housing 8 and it can be adjusted according to the direction of the rapier rods. In this manner the position of the guide tables 5 can be adapted to the width of the fabric.

Suspension bar 16 is provided along its length a plurality of horizontal slots 23. As can be seen in FIG. 3, a screw 24 is inserted into this slot and through carrier structure 15. Therefore, the carrier structure 15 may be adjustably mounted in a horizontal direction parallel to the rapier rods within slot 23 of the suspension bar 16. As shown in FIG. 1, screws 27 are inserted into slots 23 to adjustably attach suspension bar 16 to the rapier guide housing 8, which allows adjustment of the suspension bar 16 in a horizontal direction parallel to the rapier rods 2 within the limits of slots 23.

Figure 7B:
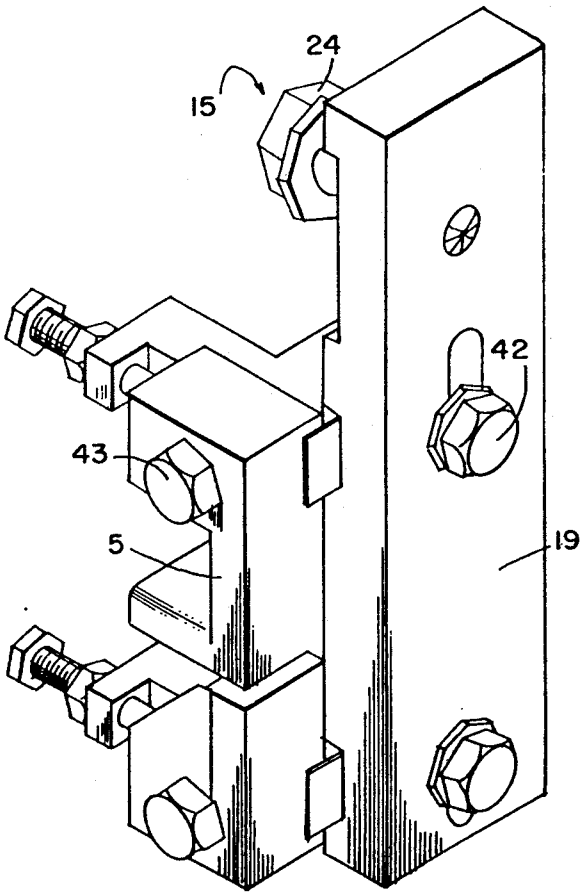
FIGS. 7*a* and 7*b* are perspective views of the carrier piece showing the attachment of the brackets and guide tables. Specifically, 7*a* is a front view and 7*b* is a rear view of these attachments.
Figure 7A:
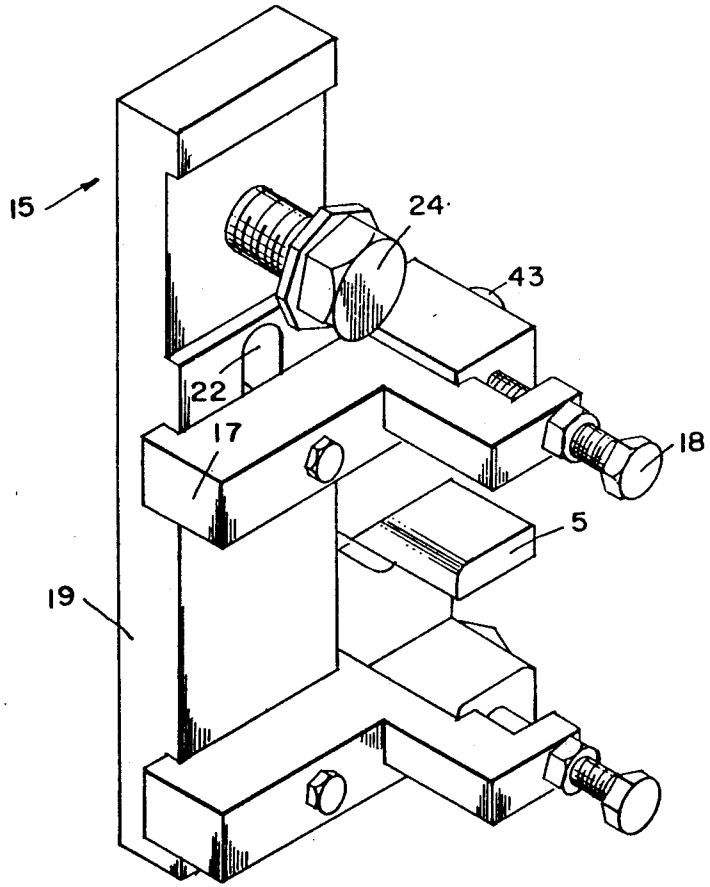

FIGS. 7*a* and 7*b* are perspective views of the carrier piece 19, on which brackets 17 are adjustably mounted, and show how guide tables 5 are each attached on these brackets 17, as a part of the rapier guide device according to the invention.

The carrier structure 15 of the guide tables 5 is such that the guide tables 5 can be set in three directions, and in such a way that each of the three directions can be set independently of the other direction, the directions corresponding to the direction of the warp, the height and the direction of the weft respectively. For this purpose, the guide tables 5 are each suspended between the legs of a horizontally positioned bracket 17. The guide tables 5 are attached to the legs of bracket 17 at two points. The first is by using bolt 43, which fixedly mounts the carrier structure to the side of the leg of the brackets 17. The other attachment means is with adjusting screws 18, which go through the front side of the leg of bracket 17 into the front of the guide table 5. This adjusting screw 18 allows the guide table 5 to be moved and set in a horizontal direction perpendicular to the rapier rods. The brackets 17 are suspended with a bolt 42 in a vertical slot 22 in a carrier piece 19, so that the height of the guide tables 5 is adjustable in a vertical direction perpendicular to the rapier rods.

It can be necessary for the rigidity and stability of the whole guide means to provide means for fixing the whole guide means additionally on the frame. For this purpose, the U-section 14 of the profiled guides 6 is provided with a support 20, which can be fixed with a bolt in a horizontal slot on a part of the frame.

Figure 4:
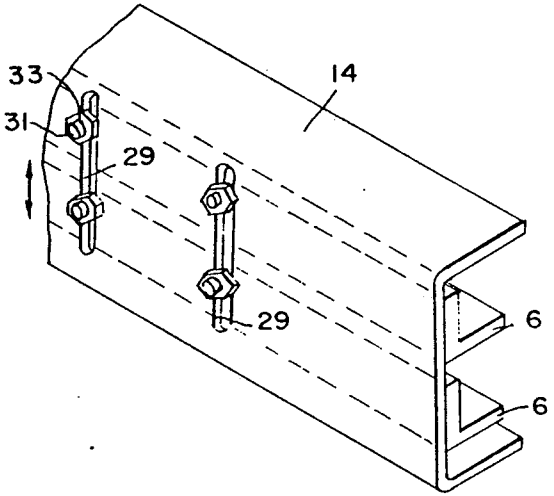
FIG. 4 is a perspective view of the U-section and shows means of adjustably mounting the profiled guides on the U-section.

As shown in FIG. 4, U-section 14 is provided with vertical slots 29. Screws 31 are inserted through guides 6 and into the vertical slots 29, and are fixed in the vertical slots by nut 33. In this way, profiled guides 6 may be adjusted in a vertical direction perpendicular to the rapier rods 2. U-section 14 is fixedly mounted on the side of rapier guide housing 8 (FIG. 1*b*).

The device according to the invention makes it possible to adjust the rapier rod guide means in an efficient and progressive manner. Once the direction of the rapier rods 2 is determined, the other guide means can be set independently of each other according to the requirement of the loom and the weaving process. It goes without saying that the present invention can be used either for face-to-face weaving or flat weaving machines.

While the invention has been described with reference to specific embodiments, modifications and variations of the invention may be constructed without departing from the scope of the invention, which is described in the following claims.

I claim:

1. A device for guiding rapier rods having rapier heads in a rapier loom, comprising at least one guide means disposed at a certain distance from a rapier driving means and along a longitudinal axis of the rapier rods;

wherein a first guide means comprises guide tables suspended between legs of a horizontally positioned bracket, the guide tables are adjustably mounted to the horizontally positioned bracket by a first adjustable means for adjusting the guide tables so that they may be adjusted in a horizontal direction perpendicular to the rapier rods, the horizontally positioned bracket is adjustably mounted on an adjustable carrier structure by a second adjustable means for adjusting the height of the guide tables in a vertical direction perpendicular to the rapier rods, and the adjustable carrier structure is adjustably mounted on a suspension bar by a third adjustable means for adjusting the carrier structure so that it may be adjusted in a horizontal direction parallel with the rapier rods, the suspension bar has a plurality of horizontal slots so that the suspension bar may be both adjustably mounted to a rapier guide housing, and be further adjusted in a horizontal direction parallel to the rapier rods.

2. The device of claim 1, further comprising a second guide means, wherein the second guide means comprises rollers which are provided in a roller frame, the rollers are attached to axes which are adjustably attached to the roller frame by a fourth adjustable means for adjusting the rollers in a vertical direction perpendicular and in a horizontal direction perpendicular to the rapier rods, and the roller frame adjustably attaches to the rapier guide housing by a fifth adjustable means for adjusting the roller frame in a horizontal direction perpendicular to the rapier rods.

3. The device of claim 2, wherein the second guide means are disposed near the rapier driving means.

4. The device of claim 1, further comprising a third guide means, wherein the third guide means comprises profile guides which are adjustably attached to a U-section by a sixth adjustable means for adjusting the profile guides in a vertical direction perpendicular to the rapier rods.

5. The device of claim 4, wherein the third guide means are disposed on a side of the rapier driving means opposite to a side turned to the rapier heads.

6. The device according to claim 1, wherein each rapier rod is driven by a drive gear wheel, and wherein the rapier guide housing is adjustably mounted to a loom housing by a seventh adjustable means for adjusting the rapier guide housing about a center line which coincides with a center line of a shaft of the gear wheels.

7. The device of claim 6, wherein a boss which contains bearings of shaft 4 is fixed directly to the loom housing, and wherein the rapier guide housing is rotatable about the boss by the seventh adjustable means.

8. The apparatus of claim 6, wherein the guide housing is provided with a number of slots, through which bolts are inserted to tighten the rapier guide housing to the loom housing.

9. The device of claim 1, wherein the first guide means are disposed between the rapier driving means and the rapier heads.

* * * * *